US005678869A

United States Patent [19]

Yoshikuwa

[11] Patent Number: 5,678,869

[45] Date of Patent: Oct. 21, 1997

[54] SWITCH FOR DETECTING FULL-LATCH CONDITION IN VEHICLE DOOR LATCH DEVICE

[75] Inventor: Masakatsu Yoshikuwa, Yamanashi-ken, Japan

[73] Assignee: Mitsui Kinzoku Kogyo Kabushiki Kaisha, Tokyo, Japan

[21] Appl. No.: 649,445

[22] Filed: May 17, 1996

[30] Foreign Application Priority Data

Jun. 1, 1995 [JP] Japan ..... 7-158492

[51] Int. Cl.[6] ..... E05C 3/16

[52] U.S. Cl. ..... 292/216; 292/337

[58] Field of Search ..... 292/216, 337, 292/DIG. 23

[56] References Cited

U.S. PATENT DOCUMENTS

| | | | |
|---|---|---|---|
| 3,666,308 | 5/1972 | Bonnaud | 292/DIG. 23 |
| 4,707,007 | 11/1987 | Inoh | 292/216 |
| 4,762,348 | 8/1988 | Matsumoto | 292/DIG. 23 |
| 4,892,340 | 1/1990 | Matumoto | 292/216 |
| 4,927,196 | 5/1990 | Girard et al. | 292/216 |
| 4,978,153 | 12/1990 | Hirsch et al. | 292/216 |
| 5,072,975 | 12/1991 | Hamada et al. . | |
| 5,074,603 | 12/1991 | Brackmann | 292/216 |
| 5,092,638 | 3/1992 | Mizuki | 292/216 |
| 5,137,311 | 8/1992 | Horst | 292/216 |
| 5,409,277 | 4/1995 | Rojer, Jr. et al. | 292/216 |

FOREIGN PATENT DOCUMENTS

| | | | |
|---|---|---|---|
| 534833 | 3/1993 | European Pat. Off. | 292/216 |
| 2717696 | 11/1978 | Germany | 292/216 |
| 61-49471 | 10/1986 | Japan . | |

*Primary Examiner*—Rodney M. Lindsey
*Attorney, Agent, or Firm*—Browdy and Neimark

[57] ABSTRACT

A vehicle door latch device comprises a latch engageable with a striker, a ratchet engageable with the latch, an open lever for releasing the ratchet from the latch so as to open the door, a lock lever displaceable between a locked position and an unlocked position, an actuator for changing over the lock lever, a switch adapted to be turned on when the latch comes into a full-latch position by the engagement with the striker, and a housing. The housing has a passage into which the striker enters, a first space for receiving the latch and the ratchet, a second space for receiving the actuator. The first space is substantially communicated with the outside through said passage, and the second space is substantially isolated from the passage so as to be sealed. The switch is attached in the second space so that a movable terminal of the switch is protruded into the first space.

10 Claims, 5 Drawing Sheets

SWITCH FOR DETECTING FULL-LATCH CONDITION IN VEHICLE DOOR LATCH DEVICE

BACKGROUND OF THE INVENTION

The present invention relates to a vehicle door latch device, and in particular to a switch for detecting a full-latch condition of a vehicle door latch device.

PRIOR ART OF THE INVENTION

Conventionally, a door latch device incorporates a switch for detecting a full-latch condition or position of a latch or fork member which is engaged with a striker, and a signal from this switch is used for controlling a room lamp, a warning lamp for a seat belt and the like.

For example, Japanese Patent Laid-open Specification No. 61-49471 discloses a door latch device which comprises a latch adapted to be engaged with a striker fixed to a vehicle body, a ratchet adapted to be engaged with the latch for holding the engagement between the latch and the striker, an open lever coupled to an open handle of a vehicle door for releasing the ratchet from the latch so as to open the door, a lock lever adapted to be displaceable between a locked position for disabling a door opening operation of the open lever and an unlocked position for enabling the door opening operation of the open lever, a housing having a passage into which the striker enters and a first space for storing the latch and the ratchet, and a switch adapted to be turned on when the latch comes into a full-latch position by the engagement with the striker, wherein said first space is communicated with the outside through the passage.

In this prior art, there is a problem due to the switch being located in the first space in which the latch and the ratchet are stored. That is, since the first space is communicated with the outside through the passage, much dust and water can easily enter into the first space. Accordingly, it has been required to use an expensive switch incorporating a high water-proof ability and a high dust-proof ability as the switch mounted in the first space. Further, the first space has to have a large capacity in order to accommodate the switch therein.

U.S. Pat. No. 5,072,975 discloses a door latch device which comprises a latch adapted to be engaged with a striker secured to a vehicle body, a ratchet adapted to be engaged with the latch for holding the engagement between the latch and the striker, an open lever coupled to an open lever of a door for releasing the ratchet from the latch so as to open the door, a lock lever adapted to be displaced between a locked position for disabling a door opening operation of the open lever and an unlocked position for enabling the door opening operation of the open lever, an actuator for changing over the lock lever between the locked position and the unlocked position, a housing having a passage into which the striker enters, a first space for storing the latch and the ratchet and a second space for storing the actuator, and a switch adapted to be turned on when the latch comes into a full-latch position by the engagement with the striker, wherein said first space is substantially communicated with the outside through the passage, wherein said second space is substantially closed so as to be isolated from the passage, wherein said switch is attached to the rear side of the housing.

In this prior art, there is also presented a problem similar to that of the former prior art. That is, since the rear surface of the housing is exposed to the outside, the switch has to have a water-proof ability and a dust-proof ability. Further, since the lock lever, the open lever and the like are provided on the rear side of the housing, it is very difficult to ensure a space for attaching the switch.

SUMMARY OF THE INVENTION

The present invention is devised in view of the above-mentioned problems inherent to the prior art, and accordingly, an object of the present invention is to provide a door latch device in which an inexpensive switch for detecting a full-latch condition can be used.

To this end, according to the present invention, the switch is stored in the second space in which the actuator is stored and which is excellent in water-proof ability and dust-proof ability.

DESCRIPTION OF THE PREFERRED EMBODIMENTS

Figure 1:
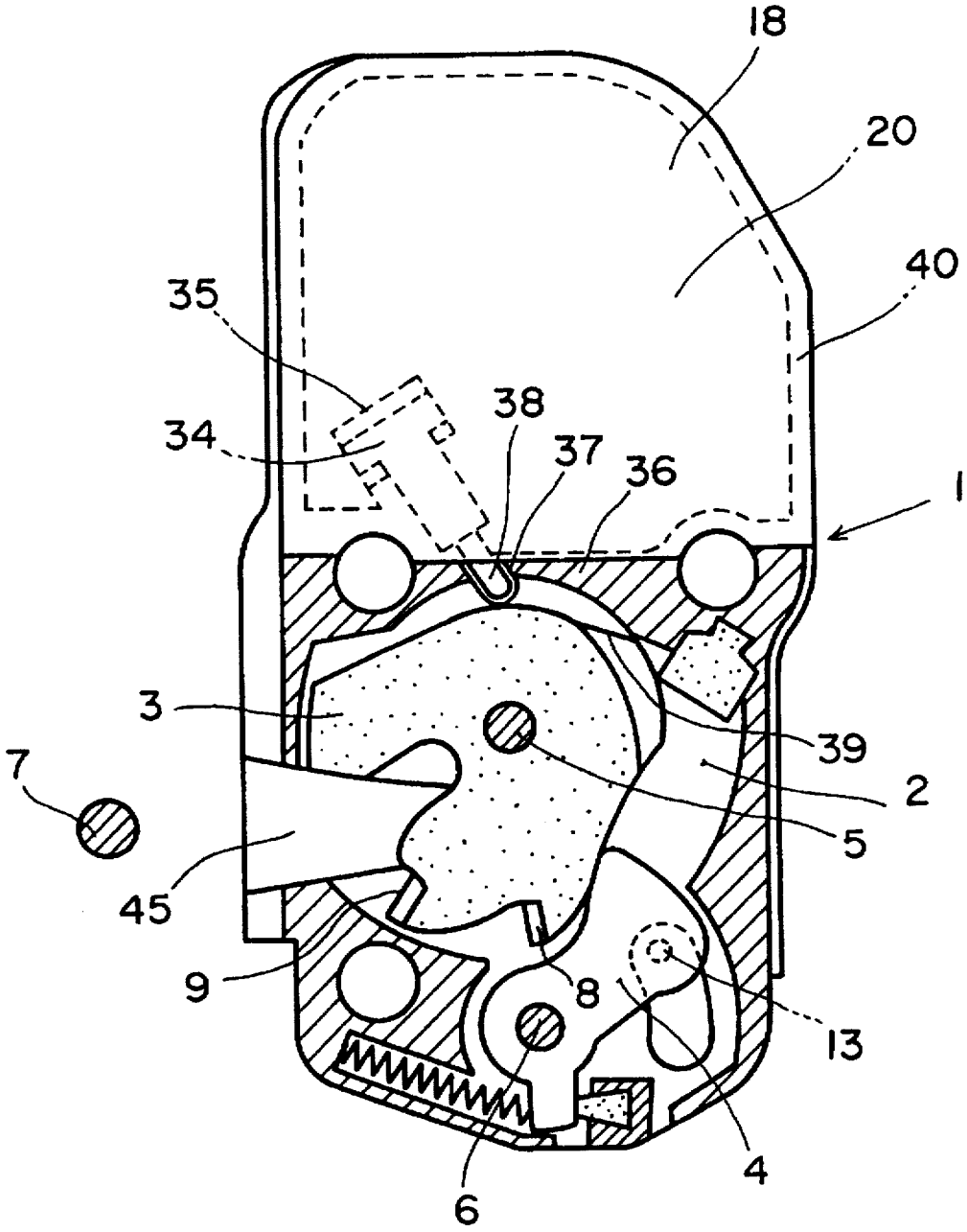
FIG. 1 is a partly transverse-sectioned front view illustrating a latch device according to the present invention.

Referring to FIGS. 1 to 4 of the drawings, a synthetic resin housing 1 of a latch device which is attached to a vehicle door has a first space 2 in a front side of the lower part thereof, a second space 20 in the upper part thereof and a third space 48 in rear side of the lower part thereof.

A latch or fork member 3 which is engageable with a striker 7 secured to a vehicle body is accommodated within the first space 2 and is rotatably supported by a latch shaft 5. A ratchet 4 which prevents reverse rotation of the latch 3 is also accommodated within the first space 2 and is rotatably supported by a ratchet shaft 6. The latch 3 is urged by a spring (not shown clockwise as viewed in FIG. 1. A metal cover plate 46 is attached to the housing 1 for covering the first space 2.

The housing 1 has a passage 45 into which the striker enters. The passage 45 is located between the latch shaft 5 and ratchet shaft 6 and is communicated with the first space 2. The cover plate 46 is formed therein with a cut-out part 47 corresponding to the passage 45. Thus, the first space 2 is substantially communicated with the outside through the passage 45 and cut-out part 47.

Figure 5:
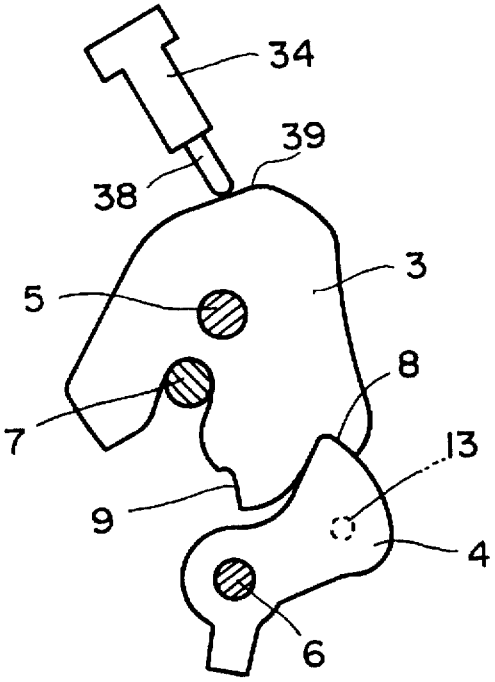
FIG. 5 is a view showing a half-latch condition.
Figure 6:
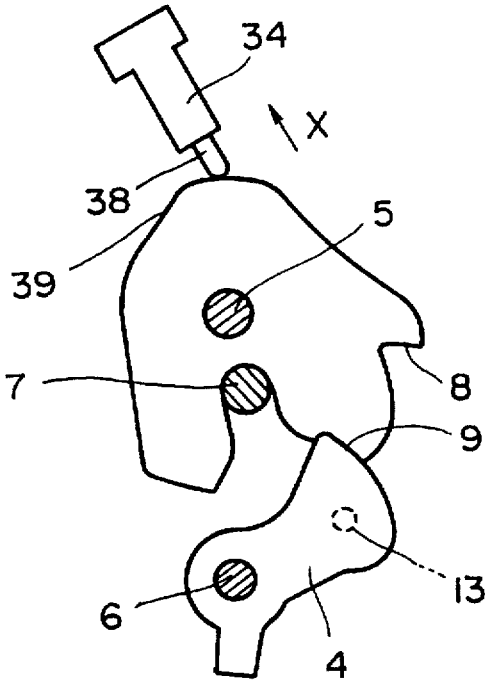
FIG. 6 is a view showing a full-latch condition.

The latch 3 is turned counterclockwise due to the engagement with the striker 7. When the latch 3 comes into a half-latch position, the ratchet 4 is engaged with a half-latch step part 8 (FIG. 5) of the latch 3, and when the latch 3 comes to a full-latch position, the ratchet 4 engages with a full-latch step part 9 of the latch 3 (FIG. 6).

Figure 7:
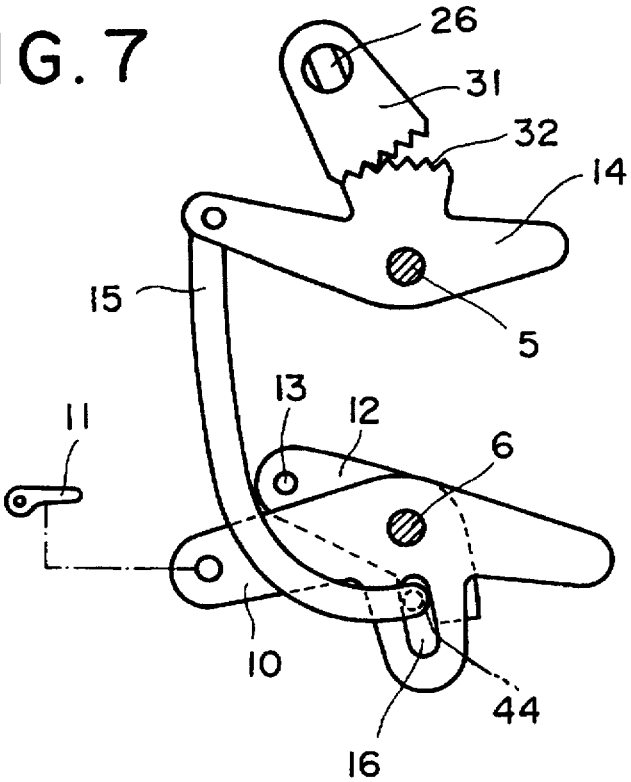
FIG. 7 is a view illustrating levers located in a third space in the housing.

Levers shown in FIG. 7 are located in the third space 48 in the rear side of the lower part of the housing 1. A T-shaped open lever 10 which is coupled to an open handle 11 of the door is rotatably supported to the ratchet shaft 6. A lock lever 14 which is displaceable between a locked position and an unlocked position is rotatably supported to the latch shaft 5. The lock lever 14 is connected with a door cylinder and/or an inside lock button which are not shown. A ratchet lever 12 which is linked to the ratchet 4 by a connecting pin 13 is also supported to the ratchet shaft 6. A link 15 has an upper end pivotally connected to the lock lever 14 and a lower end having a pin 44 which is slidably engaged in an elongated hole 16 of the open lever 10.

The lock lever 14 shown in FIG. 7 is located at the unlocked position. In this state, when the open lever 10 is turned counterclockwise by means of the opening operation of the open handle 11, the ratchet lever 12 is pushed by the pin 44 and is thus rotated counterclockwise to thereby disengage the ratchet 4 from the latch 3.

When the lock lever 14 is turned counterclockwise from the position shown in FIG. 7, it comes to the locked position. In the locked condition, the pin 44 of the link 15 is slid to a position where it cannot be engaged with the ratchet lever 12. Accordingly, in the locked condition, even though the opening operation of the open handle 11 is carried out, the latch 3 cannot be made to be free.

An actuator 17 for changing over the lock lever 14 between the locked position and the unlocked position is stored in the second space 20 formed in the upper part of the housing 1. The second space 20 is surrounded by a base casing 18, an annular wall 40 and a cover casing 19 so as to substantially prevent dust or water from entering thereinto. The base casing 18 and the annular wall 40 are formed integrally with the housing 1.

Figure 2:
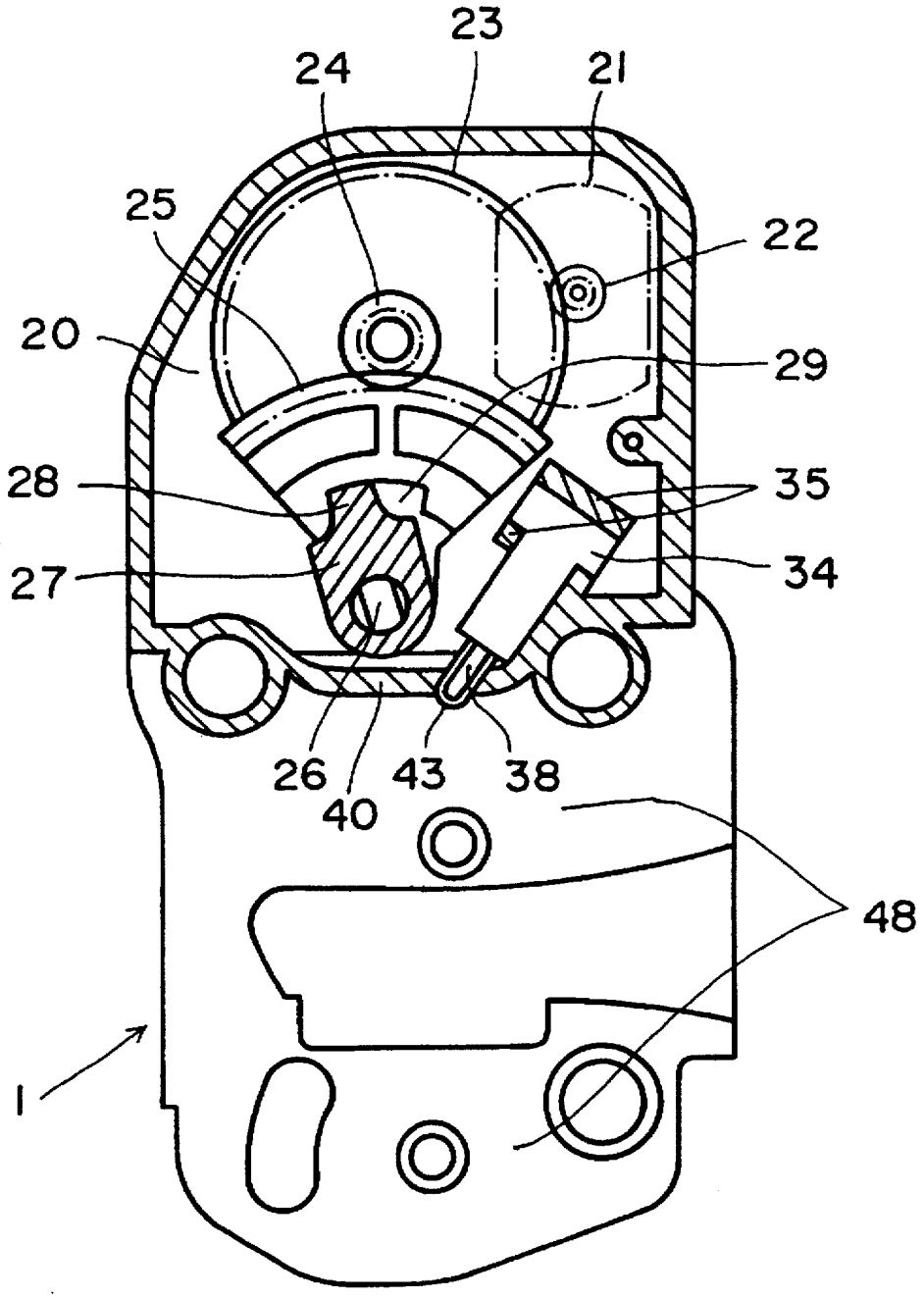
FIG. 2 is a partly transverse-sectioned rear view illustrating the latch device shown in FIG. 1.
Figure 4:
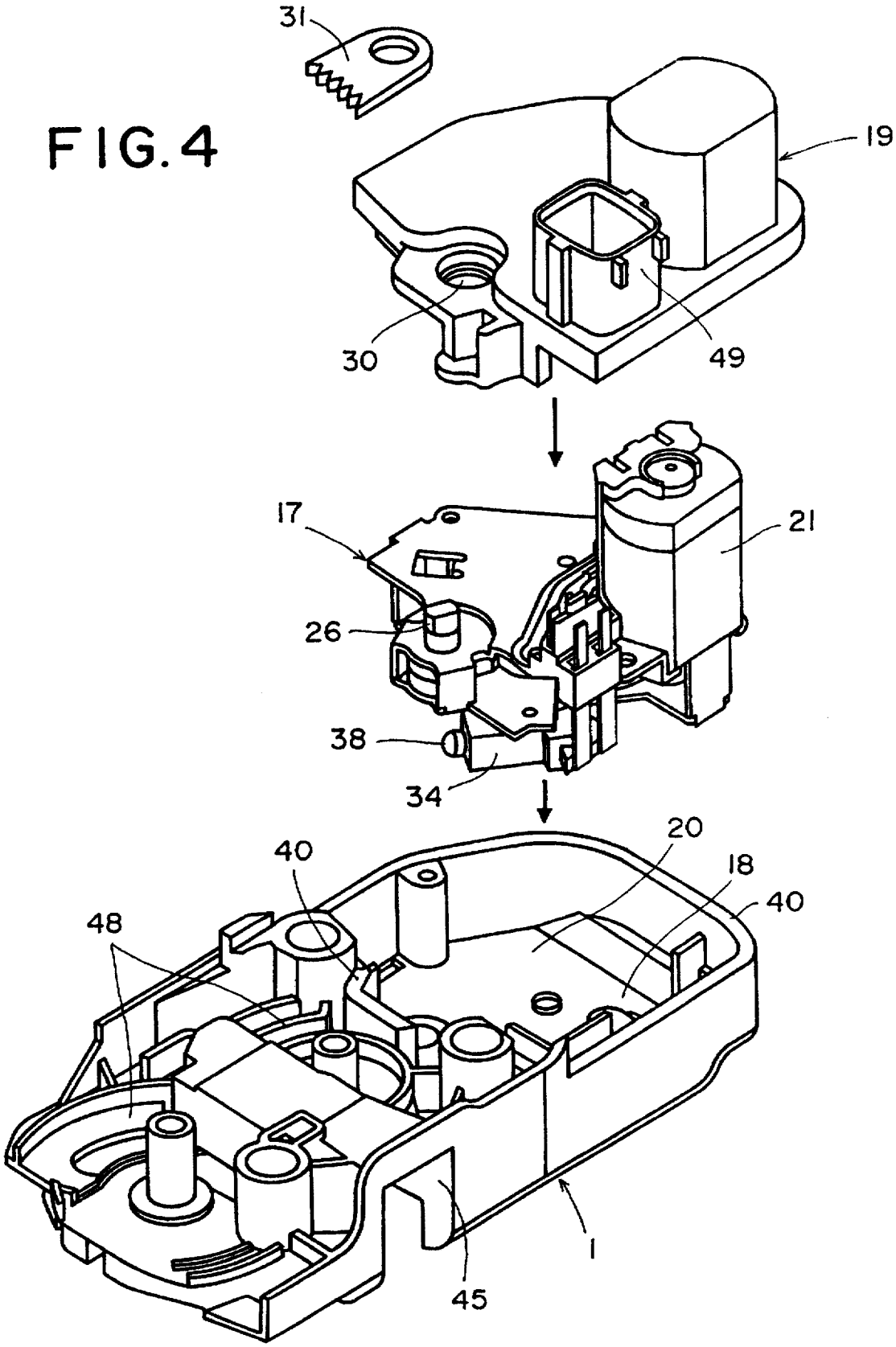
FIG. 4 is an exploded perspective view illustrating the latch device shown in FIG. 1.

Referring to FIG. 2, the actuator 17 includes a motor 21, a gear 22 fitted on an output shaft of the motor 21, a gear 23 meshed with the gear 22, and a gear 24 adapted to be integrally rotated with the gear 23. A sector gear 25 is rotatably journalled to a shaft 26 and is meshed with the gear 24. The sector gear 25 is held at a center neutral position by means of a spring which is not shown. A swing lever 27 is fitted on the shaft 26 and is engaged at its distal end 28 with a recess 29 in the sector gear 25 with a lost-motion therebetween. An output gear 31 is fitted on one end of the shaft 26 which is projected outward of the cover casing 19 through a shaft hole 30 (FIG. 4). The output gear 31 is meshed with a gear part 32 formed on the lock lever 14 as shown in FIG. 7.

Figure 3:
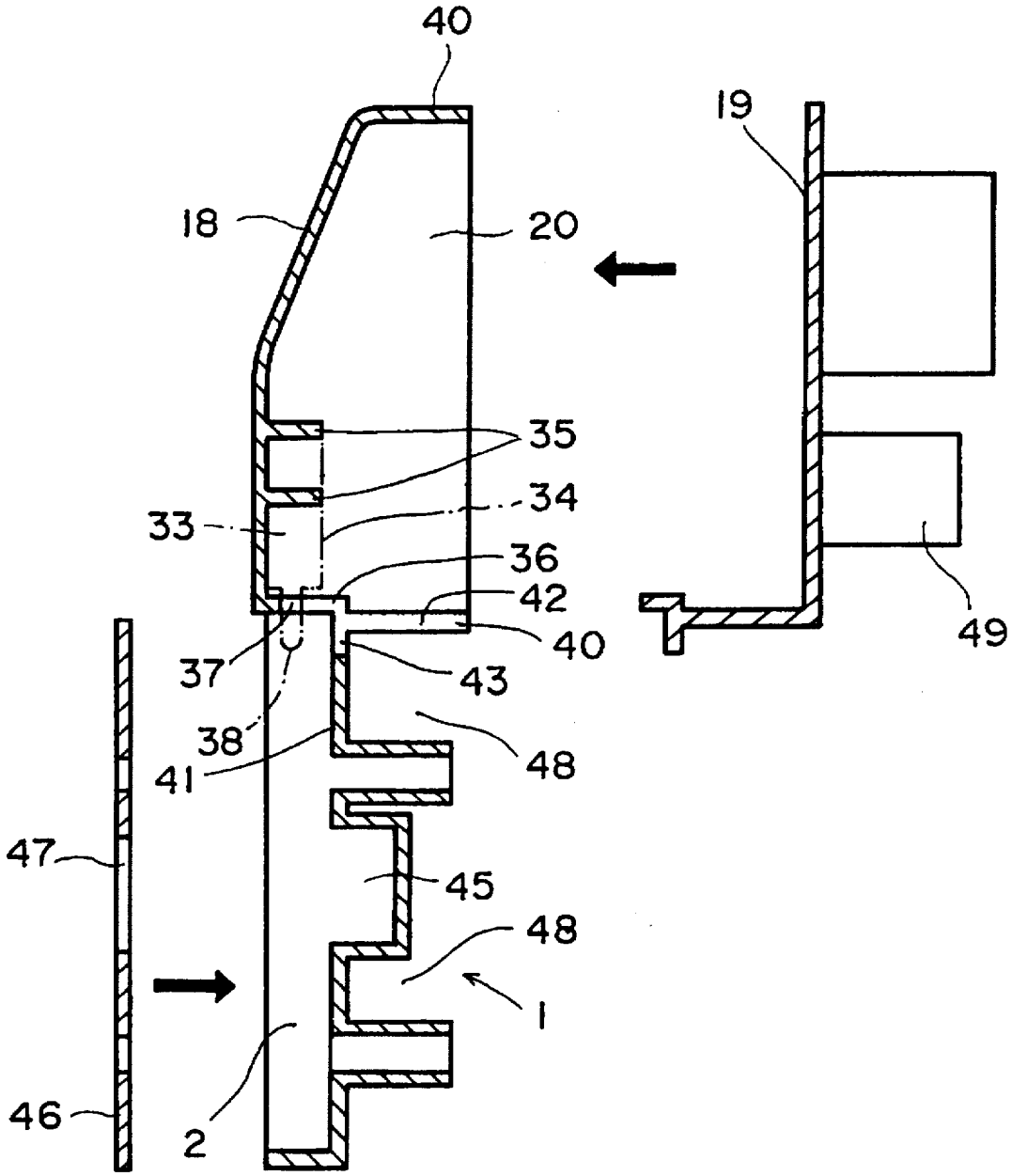
FIG. 3 is a transverse-sectional view illustrating a housing.

Referring to FIG. 3, the actuator 17 has a frame to which a switch 34 adapted to be turned on when the latch 3 comes to the full-latch position, is secured by screws or the like. After the actuator 17 is inserted in the second space 20, the switch 34 is automatically fitted in a storage part 33 defined by a support part 35 which is formed integrally with the base casing 18.

The first and second spaces 2 and 20 are separated from each other by a partition wall 36 which may be a part of the annular wall 40. The partition wall 36 is formed therein with a communication hole 37 which communicates the first and second spaces 2 and 20 with each other. A rod-like movable terminal 38 of the switch 34 is projected into the first space 2 through the communication hole 37. In the door open condition as shown in FIG. 1, the movable terminal 38 is not made into contact with the latch 3. However, when the latch 3 is turned counterclockwise toward the full-latch position, the terminal 38 is pressed by a cam surface 39 formed at an outer peripheral part of the latch 3 and is slid in a thrust direction thereof. The movable terminal 38 turns on the switch 34 when the latch 3 comes to the full-latch position. A turn-on signal from the switch 34 is used for controlling a warning lamp of a seat belt, a room lamp and the like.

The cam surface 39 of the latch 34 is formed so as to abut against the movable terminal 38 at an angle with which it is substantially orthogonal to the thrust direction of the movable terminal 38, or at a sweepback angle so that the movable terminal 38 can be smoothly pressed.

Cut-out parts 42 and 43 corresponding to the communication hole 37 are formed, as necessary, in the annular wall 40 and a bottom wall 41 of the first space 2 so that the switch 34 can easily be inserted into the storage part 33. The movable terminal 38 of the switch fitted in the storage part 33 is located being flush with the latch 3.

Connection cords or connection conductor plates for the motor 21 and the switch 34 are taken out through a socket part 49 formed in the cover casing 19.

OPERATION

At first, the latch 3 and the ratchet 4 are stored in the first space 2, and various levers shown in FIG. 7 are arranged in the third space 48. Then, the cover plate 46 is attached to the housing 1 so as to shield the first space 2. Next, after the switch 34 is attached to a surface 34' on the actuator 17 by means of screws or the like, the actuator 17 is inserted into the second space 20, and the cover casing 19 is attached to the housing 1 so as to shield the second space 20.

With the thus assembled latch device according to the present invention, the switch 34 is snugly fitted in the storage part 33 in the base casing 18 only by inserting the actuator 17 into the second space 20, and further, the movable terminal 38 of the switch 34 is projected into the first space 2 through the communication hole 37, and accordingly, the assembly of the latch device can be facilitated.

Further, when the cover casing 19 is attached to the housing 1, the second space 20 is surrounded so as to substantially prevent dust or water from entering thereinto. Accordingly, no special water-proof and/or dust-proof structure is required for the switch 34 located in the second space 20, and accordingly, an inexpensive switch can be used for the switch 34.

Further, since the communication hole 37 communicating the second space 20 with the first space 2 has a minimum size, and since the second space 20 is located above the first space 2, water or dust which has intruded into the first space 2 through the passage 45 of the housing and the cut-off part 47 of the cover plate 46 can be substantially prevented from entering into the second space 20 through the hole 47.

Further, the connection cords or plates 34" from the switch 34 can be taken out to the outside of the housing with the use of the socket part 49 through which the connection cords or plates 21' from the motor 21 are also taken out, and accordingly, it is not required to form additional holes in the base casing 18 and the cover casing 19.

Further, the cam surface 39 of the latch 3 abuts against the movable terminal 38 of the switch 34, orthogonal to the thrust direction of the movable terminal 38 of the switch 34, or at a sweepback angle thereto, and accordingly, the movable terminal 38 can smoothly slide on the cam surface 39 when it abuts against the latter.

What is claimed is:

1. A vehicle door latch device comprising:

a latch for being engaged with a striker secured to a vehicle body when a vehicle door is closed;

a ratchet engaged with the latch for holding the engagement between the latch and the striker when the vehicle door is closed;

an open lever connected with an open handle of the vehicle door for releasing the ratchet from the latch so as to open the vehicle door;

a lock lever displaceable between a locked position for disabling the open lever to open the vehicle door and an unlocked position for enabling the open lever to open the vehicle door;

actuator means for changing over the lock lever between the locked position and the unlocked position;

a housing separable from an interior housing of the vehicle door, said housing having a passage into which the striker enters, first space means for receiving the latch and the ratchet, second space means for receiving the actuator, means said first space means being substantially communicated with the outside of the housing through the passage, and said second space means being substantially isolated from the passage and encased for being sealed from the interior housing of the vehicle door and said first space means; and a switch turned on when the latch comes into a full-latch position by the engagement with the striker;

wherein said switch is attached in the second space means so that a movable terminal of the switch is protruded into the first space means.

2. A vehicle latch device according to claim 1, wherein said first space means and said second space means are parted from each other by a partition wall formed integrally with the housing.

3. A vehicle latch device according to claim 2, wherein a hole into which the movable terminal is inserted is formed in the partition wall.

4. A vehicle latch device according to claim 2, wherein said second space means is positioned adjacent to said first space means.

5. A vehicle latch device according to claim 1, wherein said movable terminal and said latch are laid being flush with each other.

6. A vehicle latch device according to claim 5, wherein said movable terminal is rod-shaped and is slid in a thrust direction.

7. A vehicle latch device according to claim 6, wherein a part of said latch which abuts against the movable terminal at an angle with which the part is substantially orthogonal to the slide direction of the movable terminal, or at a sweep-back angle to the same.

8. A vehicle latch device according to claim 1, wherein said actuator means has a surface to which the switch is secured.

9. A vehicle latch device according to claim 1, wherein said first space means is covered with a cover blare which has a cut-out part corresponding to the passage, and said second space means is covered with a cover casing formed independent from the housing.

10. A vehicle latch device according to claim 9, wherein said cover casing is formed therein with a socket part through which connection cords or connection conductor plates from the actuator means and the switch are taken out to the outside of the housing.

* * * * *